US006050547A

United States Patent [19]

Palacio et al.

[11] Patent Number: 6,050,547

[45] Date of Patent: Apr. 18, 2000

[54] ARTICULATED JACK

[75] Inventors: Joseba Palacio, Santurtzi; Iñaki Alapont, Algorta-Gexto, both of Spain

[73] Assignee: Batz, S. Coop. Ltda., Igorre, Spain

[21] Appl. No.: 09/098,383

[22] Filed: Jun. 17, 1998

[30] Foreign Application Priority Data

Jun. 19, 1997 [ES] Spain ..... 9701338

[51] Int. Cl.[7] ..... B66F 3/08

[52] U.S. Cl. ..... 254/126

[58] Field of Search ..... 254/126, 122, 254/124

[56] References Cited

U.S. PATENT DOCUMENTS 1,382,733 6/1921 Lanier .
4,055,329 10/1977 Hammond .
4,802,653 2/1989 Engel .

FOREIGN PATENT DOCUMENTS 677482 3/1930 France .
462411 9/1968 Sweden .
311087 5/1929 United Kingdom .
8602060 4/1986 WIPO .

*Primary Examiner*—Robert C. Watson
*Attorney, Agent, or Firm*—Browdy and Neimark

[57] ABSTRACT

This is an articulated jack with two pairs of arms, connecting at one end with a nut (11) and at the other with a bar (12). Both these are in turn connected by a spindle worked by a crank winding handle. The other ends of the arms rotate around a base (1) and a gripping device (2~. The outer arms (3, 4) and inner arms (5, 6) are in turn connected by auxiliary parts (18). The actual size of the jack has been considerably reduced.

11 Claims, 3 Drawing Sheets

ARTICULATED JACK

FIELD OF THE INVENTION

This invention relates to an articulated jack used to raise vehicles, of the type consisting of four interconnected arms in parallelogram format, with a threaded spindle passing through a bar and a nut connecting the ends of the two pairs of arms, and with a base or support device for the arms connecting with the aforementioned bar and nut downwards, with another upper base which in turn connects with the other two arms coming from the above-mentioned components.

The threaded spindle is connected to a crank winding handle on the outside of the nut. When this is rotated to the right or the left, the upper base is raised or lowered with respect to the lower base or support stand, and thus the load or vehicle resting on the upper base is also raised or lowered.

REVIEW OF THE RELATED TECHNOLOGY

One disadvantage of this type of articulated jack or parallelogram jack is that it is too voluminous, and therefore logically takes up considerable space inside the vehicle, contrary to the current tendencies geared towards reducing the proportions of such equipment.

SUMMARY OF THE INVENTION

One feature of the invention is that this is an articulated jack with a minimum of components.

Another feature of the invention is that this is an articulated jack which is shorter than normal for such jack types.

In order to meet these objectives, the jack has two arms connected to a bar and a further two connected to a nut. The ends of the bar arms go to the upper or gripping support base and the lower support base, respectively, as do the arms connected to the nut.

These pairs of arms have another pair of arms on the inside, and so the former are wider than the latter, so that a larger arm connected to the bar and a smaller arm connected to the nut are both connected to the support base.

Likewise, the larger arm connected to the nut and a smaller arm connected to the bar are both connected to the gripping device.

The smaller or inner arms have a U-shaped cross section for practically their entire length, and the larger or outer arms only have a U-shaped cross section around the nut and the bar, whilst the remaining areas have no base to allow the inner arms to move.

Each of the four arms has pairs of holes at the end of their flanges. Of these, one hole in each pair, respectively, points towards the base and towards the gripper, and thus they are secured by pairs of lugs protruding from each by means of pins.

Obviously, the pairs of lugs on the base are on its upper surface, and the pairs of lugs on the gripper are on the lower surface, so that the connection of lugs, pins and holes on the arms allows the arms to rotate on the base and on the gripper.

The other holes on each pair of inner and outer arms connect with shafts connecting with the opposing holes, so that two shafts lie in the support base area and a further two in the area around the gripping device.

Each pair of shafts belonging to the support base and the gripper are connected to two auxiliary parts, at least one per shaft. These auxiliary parts are basically sheets of metal with holes at the end for the aforementioned shafts, and these move around freely on the shafts.

The auxiliary parts may be arranged on the shafts in any number—two, for example, and even preferably H-shaped, as we shall mention later.

The bases of the two narrower inner arms are concave facing outwards, so that, as set out in more detail in the drawings attached, they connect with the aforementioned shafts and pins in the jack's folded position. The particular shape of these bases is technically defined in Spanish patent application N° P.9602043 submitted by this applicant.

This is an interesting point in the context of the invention, since it creates a smaller actual occupied space for the jack's folded position.

A jack constructed in accordance with this invention can reduce its actual size and also, as mentioned above, reduce the space taken up within the vehicle.

In accordance with the invention, during the raising or lowering process, the gripping device moves over a substantially vertical plane from the folded position to the unfolded position.

BRIEF DESCRIPTION OF THE DRAWING

The attached drawings show these and other details of the invention, and the following is meant as a guide to same.

DETAILED DESCRIPTION OF THE PREFERRED EMBODIMENT

Figure 1:
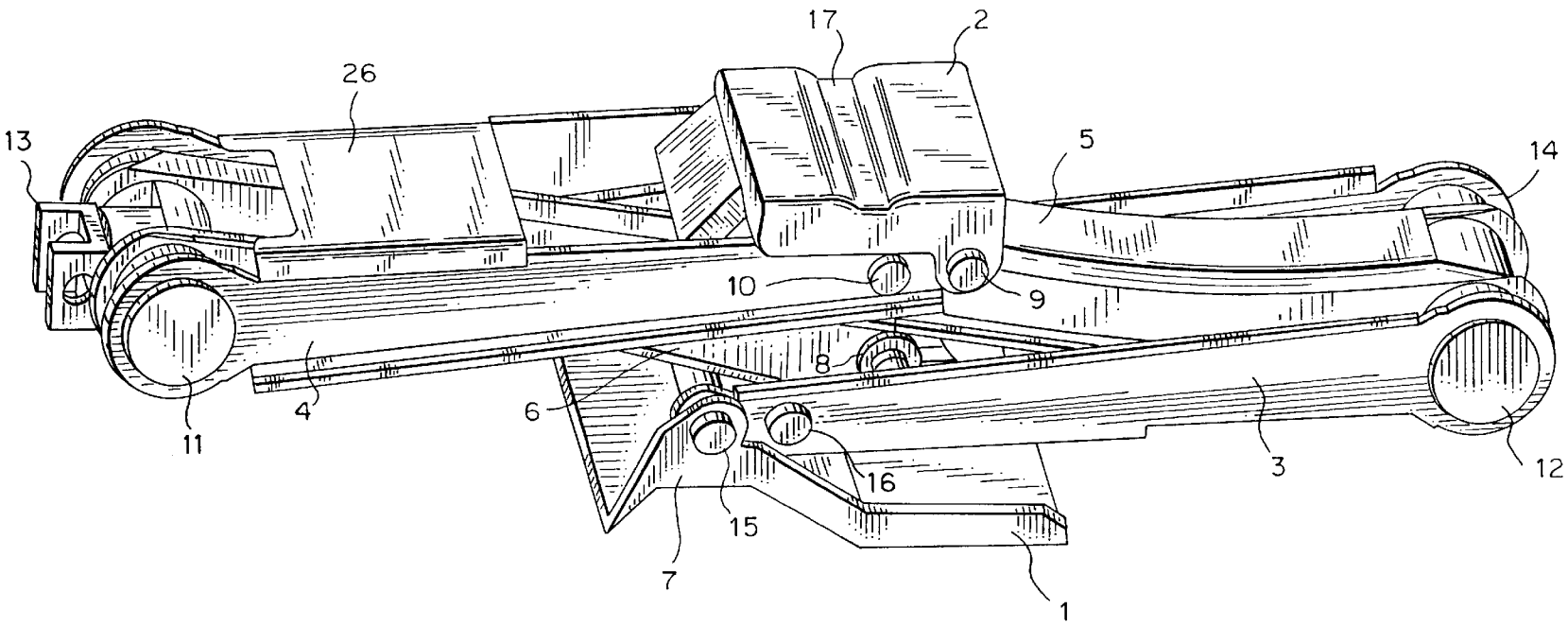
FIG. 1 shows an articulated jack nearing its totally folded position, as described in the invention.

FIG. 1 shows the jack's support base (1) and its fin (7) facing upwards. The pin (15) passes through this and is connected to the outer arm (3), which is in turn connected to the bar (12) on its right end. The inner arm (6) is also connected by means of the same system to the support base (1), and this arm is connected to the shaft (8) and this, together with the lower shaft pin (16), connects with the reinforcement device. This arm (6) is connected to the nut (11) on the left end of the jack. The threaded spindle moving between the nut (11) and the bar (12) is not shown here.

The two remaining arms—the outer arm (4) and the inner arm (5)—are connected to both pivot ends (14, 13). The arm (4) is housed in the gripper (2) by means of the pin (9), whilst the shaft (10) connects with the upper reinforcement device. The base (26) of this arm (4) stops a short distance from the nut (11), as is the case with the outer arm (3) at its other end, which is not numbered.

The other narrow arm (5) from the bar (12) connects with the gripper and is fastened to it like the outer arm (4). The base of the arm (5) is full, and it is concave facing outwards.

The gripper (2) has a crosswise groove (17) to take the edge of the body of the vehicle.

Figure 2:
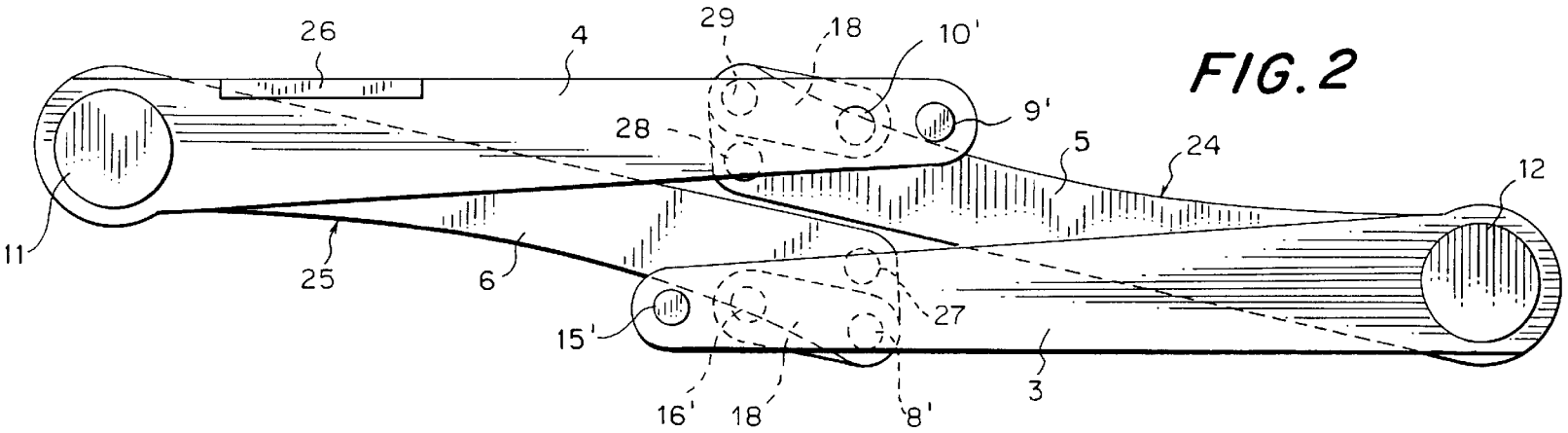
FIG. 2 shows the jack in the same position, as described in the invention, with its arms and reinforcements.

FIG. 2 is a diagram showing the position of the four arms—3 and 6 connecting with the base, and 4 and 5 connecting with the gripping device. It also shows the concave nature (25, 24) of the narrow arms and the partial base (26) of the outer arms (3, 4). The pairs of holes in the flanges of the four arms are grouped as follows:

(15', 16') on the outer arm (3)

(9', 10') on the outer arm (4)

(27, 8') on the inner arm (6)

(28, 29) on the inner arm (5)

The lower holes (15', 27) are secured to the base by its fins and pins, whilst holes 16' and 8' are for the reinforcement device (18).

Likewise, holes 9' and 28 are for the fins and pins belonging to the gripper, and holes 29 and 10' are for the shafts connecting with the upper reinforcement device (18).

Figure 3:
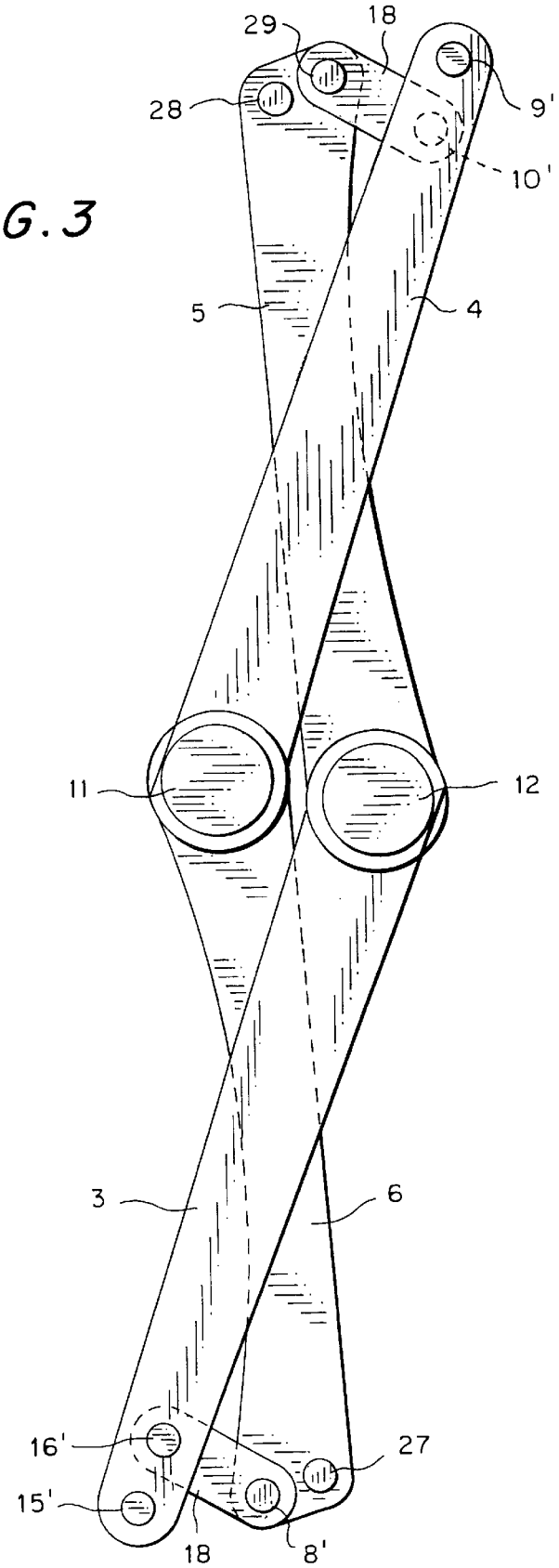
FIG. 3 shows the jack arms in the gripper's uppermost position.

FIG. 3 provides a clearer image of the relative positions, the combination and location of the various holes when the jack is in the raised position. The nut (11) and the bar (12) are in close proximity. The figure also shows how the concave shape of the narrow arms (5, 6) connects with the shafts and pins of the base and the gripper.

Figure 8:
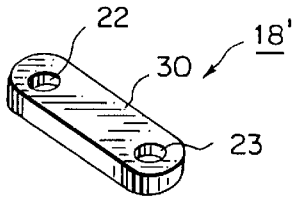
FIG. 8 shows the simplest solution of the reinforcement component

The simplest image of the reinforcement device (18') is shown in FIG. 8, embodied as a simple piece of metal (30) with holes at either end (22, 23) for the shafts (16, 10) connecting the arms.

Figure 7:
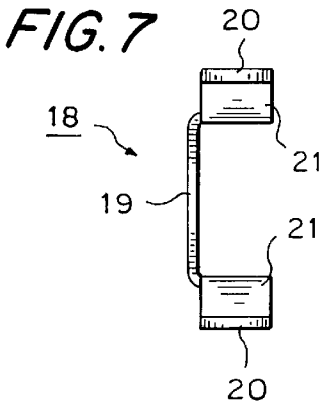
FIGS. 5, 6 and 7 provide three different views of the reinforcement component.
Figure 6:
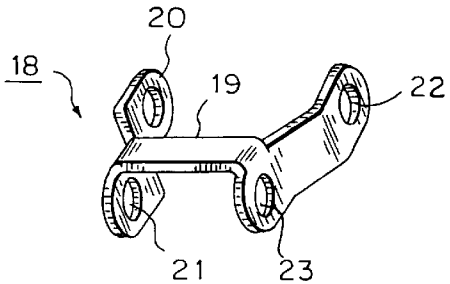
Figure 5:
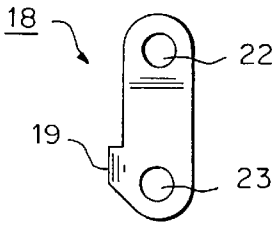

The preferred solution for the auxiliary or reinforcement device is as shown in FIGS. 5, 6 and 7, as an H-shaped part featuring flanges with larger openings (20) and a further two flanges with smaller openings (21), connecting with the central section (19). The ends of the flanges have holes (22, 23) for the shafts. This reinforcement component is perfectly visible in FIG. 6, and views from the right hand side and from above are provided by FIGS. 5 and 7.

Figure 4:
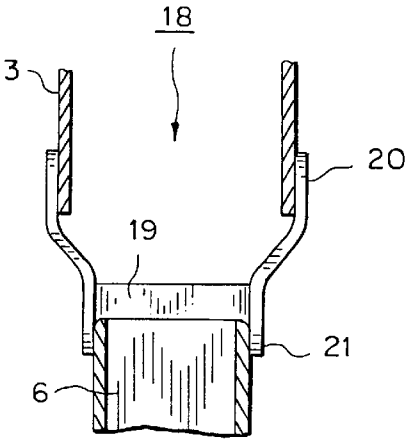
FIG. 4 shows the interrelation between the preferable reinforcement component and the two pairs of jack arms, as described in the invention.

In particular, FIG. 4 shows the auxiliary component 18 connecting with the outer arm (3) and the inner arm (6). The special configuration of this component allows it to connect with the flanges of the arms (3, 6) using the exterior of the flanges. FIG. 4 does not show the shafts connecting with the auxiliary or reinforcement component.

Once the function and the advantages of this invention have been described, its nonlimitational nature should be made clear, and so any changes to shapes, materials or dimensions of its components shall in no way alter its essential function, provided these do not cause considerable variation to the assembly.

What is claimed is:

1. An articulated jack for raising a vehicle body, the jack comprising:

a support base (1), an upper gripping device (2) for contacting an edge of the vehicle body, a first pivot joint (13) including a nut (11), and a second pivot joint (14) including a bar (12);

a spindle passing through the nut (11) on the first pivot joint (13) and connected to the bar (12) on the second pivot joint (14);

four arms (3,4,5,6), a pair of which are connected to each of the first pivot joint (13), the second pivot joint (14), the support base (1), and the upper gripping device (2);

the arms including two wider outer arms and two inner arms, and further comprising a lower outer arm (3) hinged to the support base (1) and the second pivot joint (12), an upper outer arm (4) hinged to the gripping device and the first pivot joint (13), an upper inner arm (5) hinged to the gripping device and the second pivot joint, and a lower inner arm (6) hinged to the support base and the first pivot joint;

each of the arms including a respective outer end adjacent to a respective pivot joint, and a respective inner end adjacent to the support base or to the upper gripping device;

the outer arms (3,4) each including a respective outer U-shaped cross section including a base (26) over a portion in close proximity to the outer ends thereof, and each including no base in proximity to the inner ends thereof;

the inner arms (3,4) each including a respective inner U-shaped cross section; and two auxiliary components (18, 18') including one close to the base (1) and another close to the gripper (2), the auxiliary components providing interior connections between the lower inner arm (6) and the lower outer arm (3) and between the inner arm (5) and the upper outer arm (4);

each of the arms respectively including at the inner end thereof two pairs of inner end holes (15', 16'; 8', 27; 28, 29; 10', 9') including a first pair of inner end holes (15', 27, 9', 28) whereby the respective inner end connects with the base or the gripper via a shaft, and a second pair of inner end holes (16', 8', 29, 10') whereby the respective inner end connects with one of the auxiliary components (18, 18') connecting the inner and outer arms;

the auxiliary components being freely rotatable relative to the arms.

2. The jack according to claim 1, wherein the auxiliary components (18) are generally H-shaped including side sections further comprising flanges, the flanges including two more-separated flanges (20) having a greater distance between them and two less-separated flanges (21) having a lesser separation (21) between them, wherein the flanges include aligned holes (22, 23) whereabout the inner and outer arms rotate, and wherein the side sections are positioned in respective spaces between the inner and outer arms.

3. The jack according to claim 1, wherein the auxiliary components comprise bars of metal (30) in pairs, with holes (22, 23) at either end, and disposed in both areas around the base (1) and the gripper (2).

4. The jack according to claim 1, wherein the outer arms (3,4) and the inner arms (5,6) are connected to lug projections on the base and the gripper by pins with riveting.

5. The jack according to claim 1, wherein the auxiliary components (18) are fastened to the arms by pins with riveting at ends thereof.

6. The jack according to claim 1, wherein the auxiliary components (18) are fastened to the arms by riveting.

7. The jack according to claim 1, wherein the inner arms (5,6) are concave facing outward from the outer U-shape.

8. The jack according to claim 1, wherein the U-shaped cross section is continuous.

9. The jack according to claim 1, wherein the pair of arms which are connected to the support base (1) are hinged thereto by pins (15, 16) disposed on the support base such that the pair of arms is crossed adjacent the support base, and wherein the pair of arms which are connected to the upper gripping device (2) are hinged thereto by pins (9, 10) disposed on the upper gripping device such that the pair of arms is crossed adjacent the upper gripping device.

10. The jack according to claim 9, wherein the end holes (28, 29; 8', 27) of each inner arm (5, 6) are disposed in a line generally perpendicular to a length of the inner arm, and wherein the end holes (15', 16', 9', 10') of each outer arm (3, 4) are disposed in a line generally parallel to a length of the outer arm.

11. The jack according to claim 1, wherein the inner arms include a U-shaped cross section for substantially an entire length thereof.

* * * * *